US005904018A

United States Patent [19]

Campagnari

[11] Patent Number: 5,904,018

[45] Date of Patent: May 18, 1999

[54] SYSTEM OF STRUCTURAL ELEMENTS, PARTICULARLY FOR BUILDING INTERNAL WALLS

[75] Inventor: Federica Campagnari, Redondo Beach, Calif.

[73] Assignee: Plamet Limited Liability Company, Cheyenne, Wyo.

[21] Appl. No.: 08/667,840

[22] Filed: Jun. 20, 1996

[51] Int. Cl.[6] ..... E04B 5/46

[52] U.S. Cl. ..... 52/306; 52/592.1; 52/656.9

[58] Field of Search ..... 52/306–308, 656.9, 52/475.1, 476, 762, 777, 780, 781, 592.1, 591.1; 446/122

[56] References Cited

U.S. PATENT DOCUMENTS

| | | | |
|---|---|---|---|
| 4,625,483 | 12/1986 | Zacky et al. | 52/282.3 X |
| 4,635,420 | 1/1987 | Batky | 52/308 X |
| 4,831,804 | 5/1989 | Sayer | 52/656.9 X |
| 4,891,925 | 1/1990 | Carlson et al. | 52/306 X |
| 4,959,937 | 10/1990 | Emil | 52/306 X |
| 5,031,372 | 7/1991 | McCluer | 52/307 |
| 5,033,245 | 7/1991 | Kline | 52/306 |
| 5,038,542 | 8/1991 | Kilne | 52/306 |
| 5,095,671 | 3/1992 | Mitani | 52/780 X |
| 5,224,792 | 7/1993 | Hagenah | 52/604 X |
| 5,430,985 | 7/1995 | Coleman | 52/308 |
| 5,448,864 | 9/1995 | Rosamond | 52/308 X |
| 5,588,271 | 12/1996 | Pitchford | 52/306 |
| 5,595,033 | 1/1997 | Frey | 52/306 |

*Primary Examiner*—Carl D. Friedman
*Assistant Examiner*—Beth Aubrey
*Attorney, Agent, or Firm*—Rockey, Milnamow & Katz, Ltd.

[57] ABSTRACT

The system has hollow parallelepiped modular components which are each composed of two interlocking half-shells. Raised portions provided on the sides of the modular components engage seats formed in respective locking and profiled elements for interconnecting the modular components. A profiled element is provided for covering the upper and lower edges of the mutually interlocked modular components. The profiled element has a C-shaped inner core, provided with grooves defining undercut ridges for snap-together engagement with the raised portions of adjacent modular components, and a U-shaped profiled element for housing the C-shaped inner core. L-shaped elements, provided for fixing the assembled system, each have one wing fixable within an interspace defined within the C-shaped inner core and another wing fixable to a wall, floor or ceiling.

18 Claims, 9 Drawing Sheets

SYSTEM OF STRUCTURAL ELEMENTS, PARTICULARLY FOR BUILDING INTERNAL WALLS

BACKGROUND OF THE INVENTION

The present invention relates to a system of modular structural elements for building walls, particularly adapted for interiors.

In the technical field of building construction, engineers, architects and interior designers undertaking new-construction, renovation projects, or interior design work, are faced with the problem of optimizing the sub-division of building interiors, according to numerous factors including the type of building, the intended use of the building, and the aesthetic effect that one may desire to create when designing the building interior.

When building offices, for example, it is frequently desired to have large internal rooms which are subsequently sub-divided or partitioned according to the specific requirements of the occupants. In other commercial buildings such as showrooms, which typically have one or more large, undivided internal spaces, it may be subsequently desired to erect one or more interior walls to delimit one or more office spaces or meeting rooms. Similar problems are faced when renovating buildings to be used for a purpose other than that for which they were originally designed, and also when restoring old buildings that have planning restrictions or preservation orders placed on them, whereby the structure of the building can only be modified to a very limited extent.

In such cases, in homes and in workplaces, internal walls are erected to sub-divide the interior building space. However, it is frequently desired to erect internal walls which can be easily modified, to allow for any possible future changes in the use and/or aesthetic requirements of the building interior.

Modular internal walls have been developed which comprise a plurality of mutually interconnectable blocks. Known modular blocks for erecting internal walls typically comprise parallelepiped blocks, having a first vertical edge provided with a female connection groove, and an opposite and parallel vertical edge provided with a male connection element for connection to the female connection groove of an adjacent block. The upper and lower horizontal edges of the adjacent modular blocks have mutually facing connectors for mutually coupling the blocks horizontally.

However, such known modular blocks for building internal walls have some serious drawbacks, not least of which is the fact that they are often difficult to erect and require skilled personnel and special tools, equipment and cements or adhesives for installation. Furthermore, known modular blocks for building internal walls cannot be readily utilized to create special optical and decorative effects in the interior spaces of the building. Moreover only a limited number of geometrical configurations can be adopted when building internal walls with the known modular blocks, which cannot always be readily used, for instance, to erect walls having a curved configuration.

SUMMARY OF THE INVENTION

A pricipal aim of the present invention is to provide a system of modular structural elements that allows to erect, in a relatively simple and quick manner, both straight and curved walls with different radii of curvature, without using cements or adhesives between the structural elements.

An object of the present invention is to provide a system of modular structural elements which allows to erect walls without using any special tools, other than those normally used by an interior fittings installer.

Another object of the present invention is to provide a system of modular structural elements which allows to quickly and easily erect walls, partitions, and the like that can create special optical and decorative effects in the interiors of living or working spaces.

With this aim, these and other objects in view, there is provided a system of structural elements particularly for internal walls, as defined in the appended claims.

Advantageously, the system of structural elements according to the invention comprises a plurality of modular components, and each one of said modular components is constituted by two halves that are held together by fixing means.

BRIEF DESCRIPTION OF THE DRAWINGS

Further aspects and advantages of the present invention will become apparent from the following detailed description of some currently preferred embodiments thereof, described only by way of non-limitative example with reference to the accompanying drawings, wherein.

DESCRIPTION OF THE PREFERRED EMBODIMENTS

Figure 1:
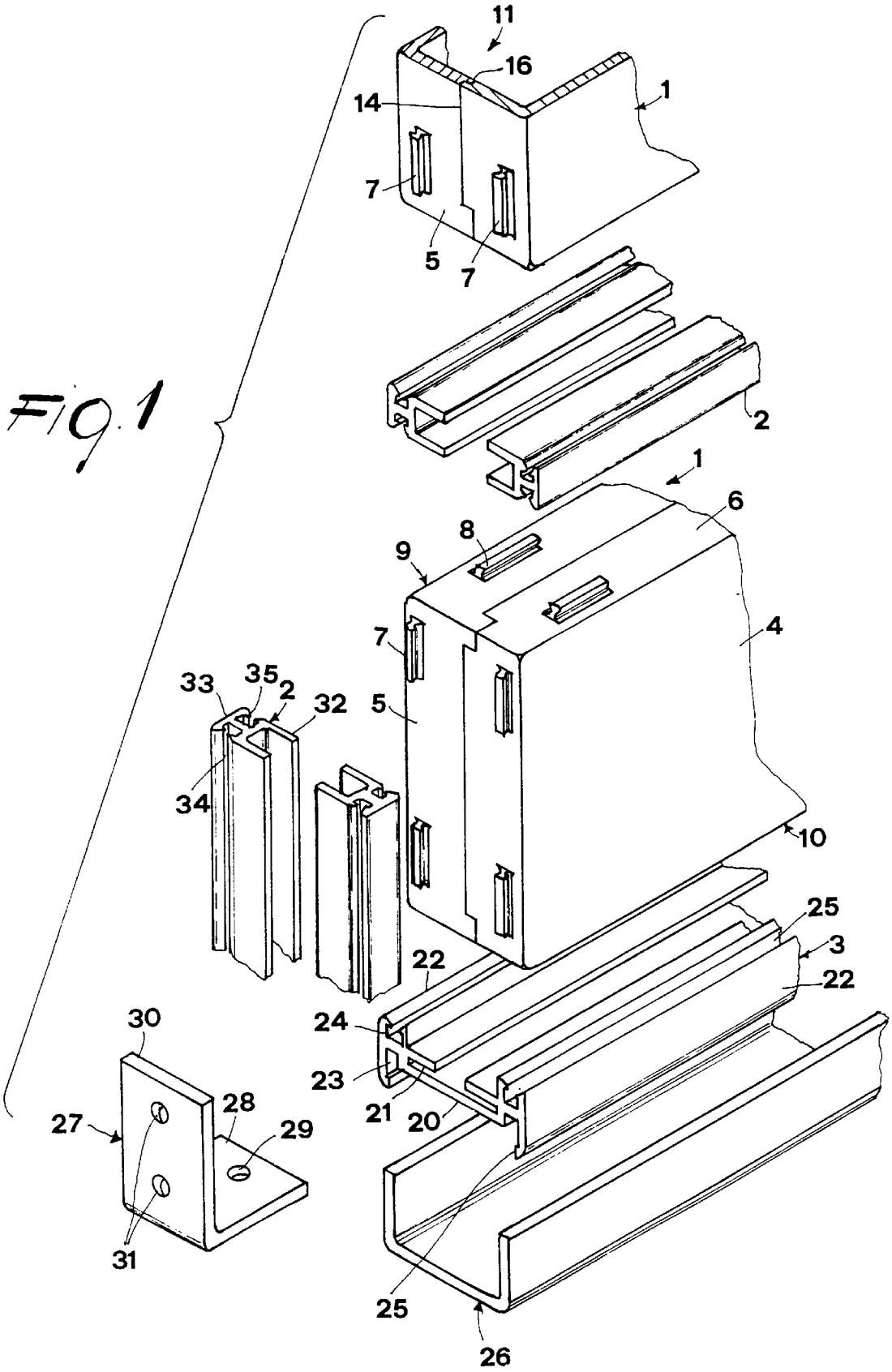
FIG. 1 is a schematic exploded perspective view of a portion of a wall that can be obtained with the system of structural elements according to the invention.
Figure 3:
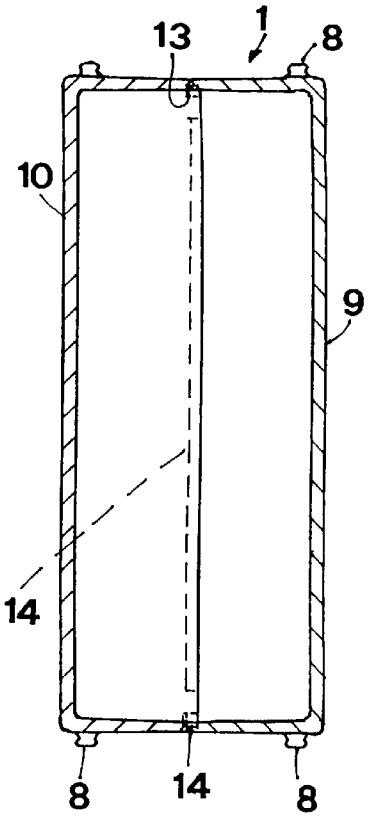
FIG. 3 is a sectional view, taken along the plane III—III of FIG. 2.
Figure 2:
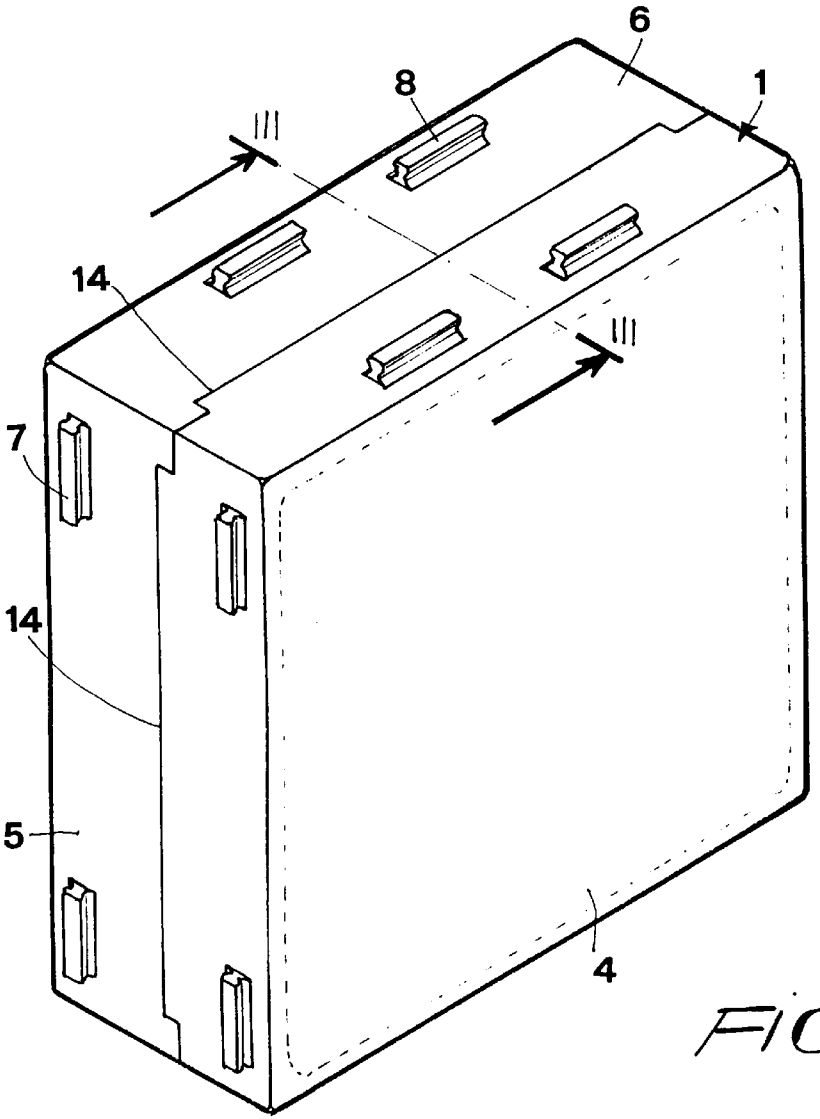
FIG. 2 is a perspective view of a hollow modular component formed by two mutually opposite half-shells.
Figure 4:
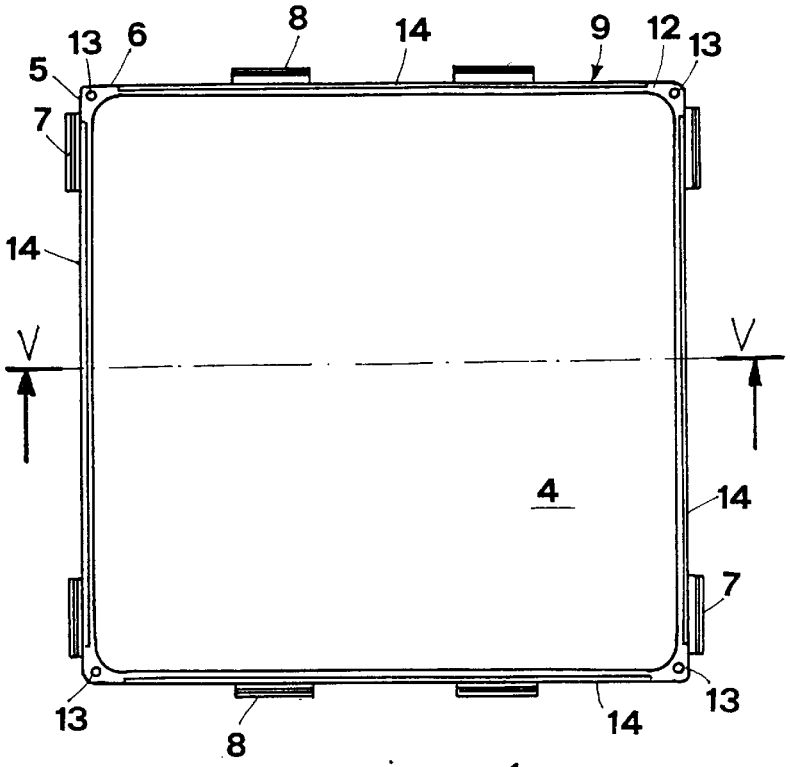
FIG. 4 is a plan view of the inside of a male half-shell of the modular component of FIG. 3.
Figure 5:
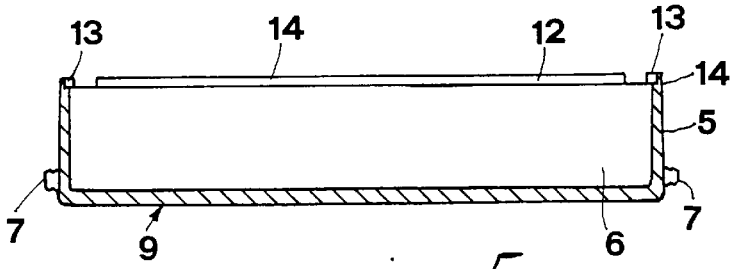
FIG. 5 is a sectional view, taken along the plane V—V of FIG. 4.
Figure 6:
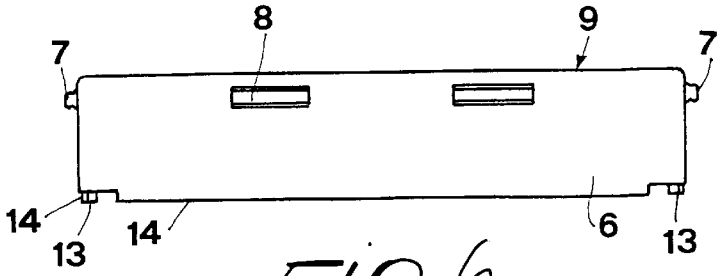
FIG. 6 is a top view of the half-shell of FIG. 4.
Figure 9:
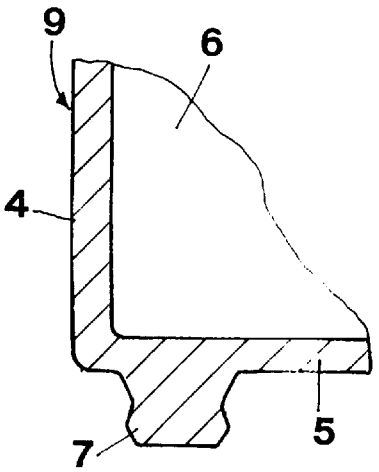
FIG. 9 is an enlarged-scale sectional view of a detail, taken along the plane IX—IX of FIG. 7.
Figure 8:
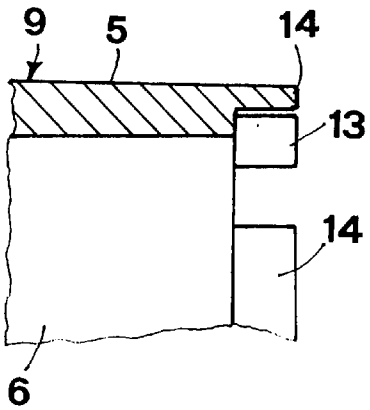
FIG. 8 is an enlarged-scale sectional view of a detail, taken along the plane VIII—VIII of FIG. 7.
Figure 7:
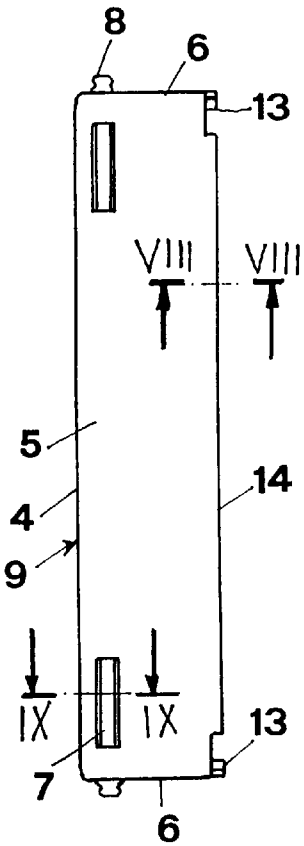
FIG. 7 is a side view, taken from the left, of the half-shell of FIG. 4.
Figure 10:
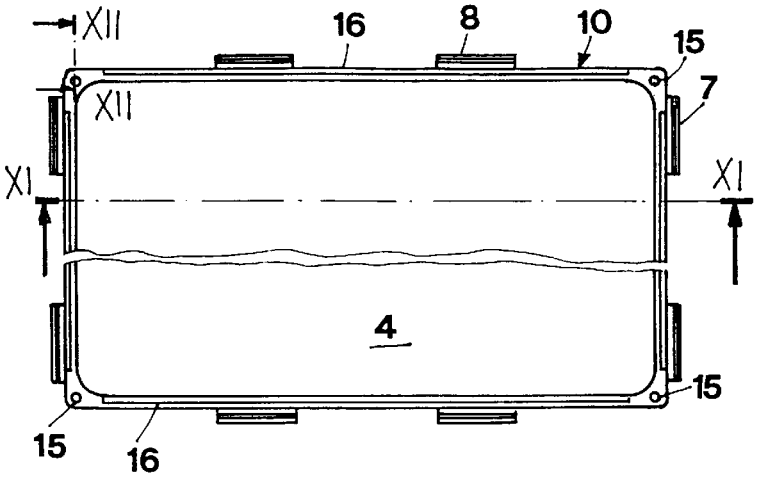
FIG. 10 is a plan view of the inside of a female half-shell of the modular component of FIG. 3.
Figure 11:
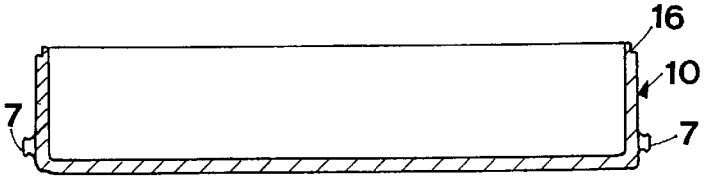
FIG. 11 is a sectional view, taken along the plane XI—XI of FIG. 10.
Figure 12:
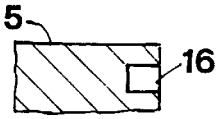
FIG. 12 is an enlarged-scale sectional view of a detail, taken along the plane XII—XII of FIG. 10.
Figure 13:
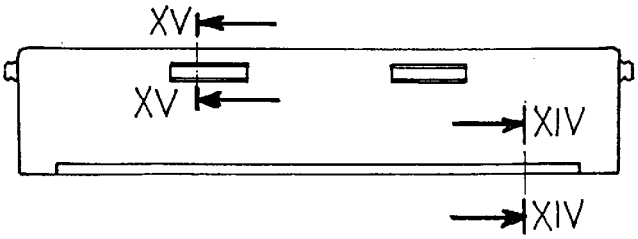
FIG. 13 is a top view of the half-shell of FIG. 10.
Figure 14:
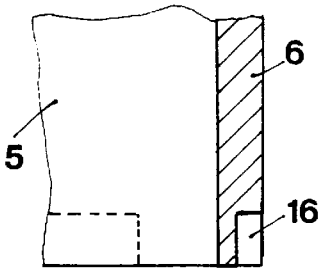
FIG. 14 is an enlarged-scale sectional view of a detail, taken along the plane XIV—XIV of FIG. 13.
Figure 15:
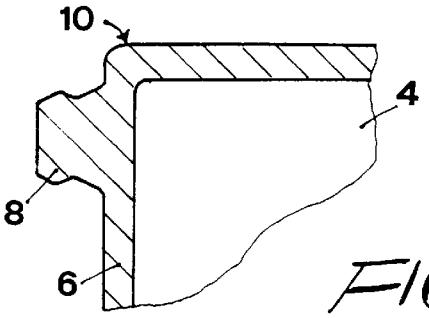
FIG. 15 is an enlarged-scale sectional view of a detail, taken along the plane XV—XV of FIG. 13.
Figure 16:
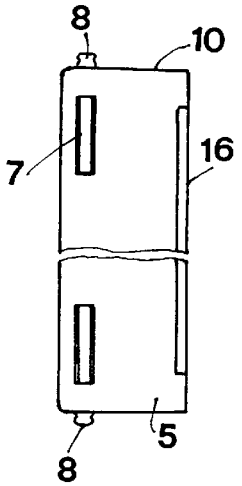
FIG. 16 is a side view, taken from the left, of the half-shell of FIG. 10.
Figure 17:
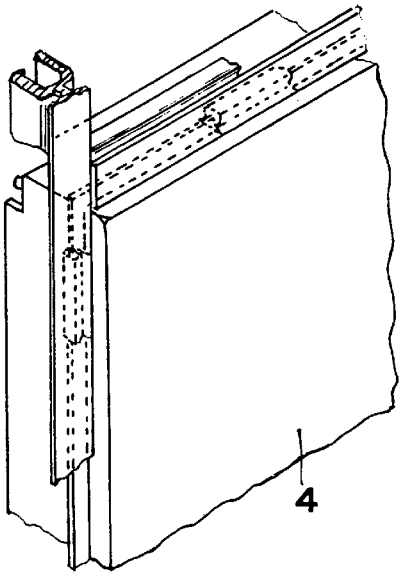
FIG. 17 is a partial perspective view of a male half-shell, to which locking and trimming profiled elements are applied.
Figure 18:
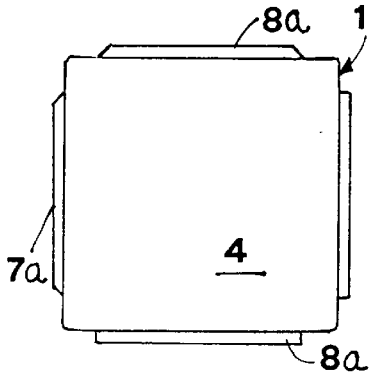
FIG. 18 is a front elevation view of a different embodiment of the hollow modular component, with two half-shells, of the system of structural elements according to the invention.
Figure 19:
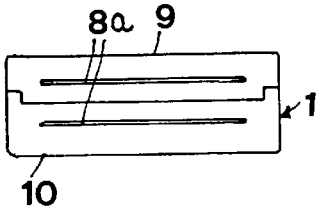
FIG. 19 is a bottom plan view of the hollow modular component of FIG. 18.
Figure 20:
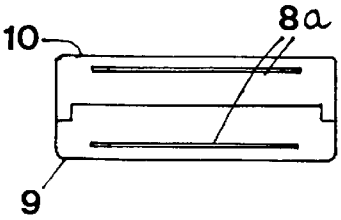
FIG. 20 is a top plan view of the hollow modular component of FIGS. 18 and 19.
Figure 21:
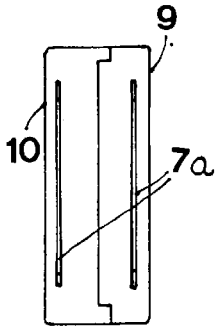
FIG. 21 is a lateral elevational view of the hollow modular component of FIGS. 18–20, as seen from one side thereof.
Figure 22:
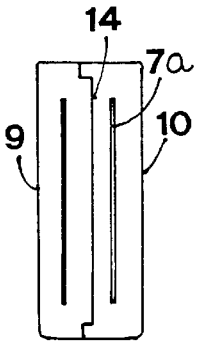
FIG. 22 is a lateral elevational view of the hollow modular component of FIG. 18–21, as seen from another side thereof.

In the accompanying drawings, identical or similar parts have been designated by the same reference numerals.

Initially with reference to the embodiment shown in FIGS. 1 to 17, the system of structural elements for forming a wall, particularly an interior wall, is formed by a plurality of modular components 1, a plurality of locking and trimming profiled elements 2, and by a base and top profile 3.

Each modular component 1 has the shape of a parallelepiped, with two larger faces 4 having a square or rectangular contour and vertical sides 5 and horizontal sides 6 that are relatively narrow and are affected by four raised portions, designated by the reference numeral 7 on the vertical sides and by the reference numeral 8 on the horizontal sides, which are aligned in pairs and spaced from one another.

Advantageously, each modular component 1 is constituted by two half-shells 9 and 10 that are mutually adjacent, are engaged by a male-female coupling, and delimit an internal space 11.

More particularly, the half-shell 9 is a male half-shell having, at the edge 12 for mating with the female half-shell 10, a protruding pin or peg 13 in each corner and a straight raised portion 14 (which constitutes an extension of the outer surface) or a plurality of straight raised portions which are aligned along at least part of each side or lateral face 5 and 6. The female half-shell 10 has, at its edge 12 for mating with the male half-shell 9, at each corner, a hole or seat 15 for accommodating a corresponding pin or peg 13 of a male half-shell and has a corresponding external straight recess 16 or a plurality of straight recesses which are aligned along at least part of each lateral face 5 and 6.

Preferably, the raised portions 7 and 8 on the lateral faces 5 and 6 of the half-shells 9 and 10 are shaped so as to provide a dovetail male-female coupling, i.e., they have a slight undercut to engage and anchor in corresponding seats in the bottom profiled element 3 or in the locking profiled element 2, as explained hereinafter.

Each bottom or top covering profiled element 3 (FIG. 1) can be constituted by an extruded part made of light alloy or plastics that is symmetrical with respect to a median longitudinal sectional plane. More particularly, it is formed by a C-shaped inner core 20 which delimits an internal interspace 21 and by a double lateral set of wings that forms, on each side of the profiled element, an external trimming edge 22 and two longitudinal grooves 23 and 24 that are directed on opposite sides with respect to each other. The opposite lips of each groove 24 are preferably provided with a ridge 25 that forms an undercut for snap-together engagement with the raised portions 7 and 8 of the modular components 1.

The grooves 23 are instead meant to engage the free edges of a profiled or solid U-shaped element 26, made for example of metal or plastics, which is fixed, for example by means of bolts that can be screwed into wall anchors or by means of screw anchors, to the floor or ceiling of a room or to a vertical wall thereof.

In order to fix a bottom profiled element 3 at its tip, it is possible to use an L-shaped element 27 which, with one of its wings 28, enters the internal interspace 21 of the bottom profiled element and is coupled to a profiled element 3 by means of a screw that passes through the hole 29; at its other wing 30, said L-shaped element can be fixed, for example by means of screw anchors or nails that pass through the holes 31, to a side wall or to the ceiling or to the floor of a room in which a wall must be erected with the system according to the present invention.

Each one of the locking and trimming profiled elements 2 is formed by a U-shaped metal or plastic profiled element 32, having a T-shaped ridge 33 extending from a rear surface thereof; said ridge delimits, together with the U-shaped portion, two opposite longitudinal seats 34 and 35 for accommodating and retaining raised portions 7 and 8 of the modular components 1. The stable coupling between the modular component and the locking profiled element is best ensured by the precision of the fit between the seats 34 and 35 and the raised portions 7 and 8. For this purpose, the inlet lips of the seats 34 and 35 can preferably have a slight undercut for snap-together coupling and retention in a more stable position.

Furthermore, the outer face of the transverse wing of the T-shaped ridge 33 constitutes a trimming surface, which is optionally painted and/or anodized in the desired color or colors, at the gap regions between one modular component 1 and the next.

The locking and trimming profiled elements can equally have a straight shape, to, build straight walls, and a curved shape, for curved walls or wall portions. In FIG. 1, the profiled elements 2 are used in pairs, one on each side of the modular components 1.

According to a preferred embodiment of the invention, the modular components 1 are shaped like a parallelepiped, measuring for example 193×193×78 mm, and are made of transparent plastics with high impact-resistance and good weather-resistance characteristics, particularly resistance to ultraviolet rays and to scratching, such as for example polycarbonate, polymethyl methacrylate, glass, and the like.

The surfaces of the internal space 11 can be machined or variously shaped so as to distort images in a desired manner without appreciably reducing the passage of light. Furthermore, the material of which the half-shells 9 and 10 are made can be of various tints or colors according to the desired optical effects.

The installation of a system of modular components according to the present invention is extremely easy, quick, and precise, and can be performed even by personnel that has not been particularly trained.

FIGS. 18 to 22 illustrate another embodiment of a modular component 1*a,* which instead of the raised portions 7 and 8 has two straight and parallel tabs 7*a* and 8*a* on each side, one on each half-shell 9 and 10.

Figure 23:
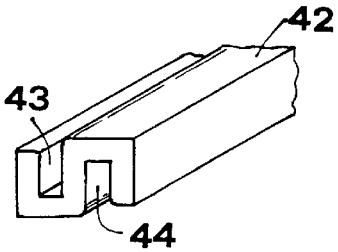
FIG. 23 is a perspective view of a locking and trimming profiled element.
Figure 24:
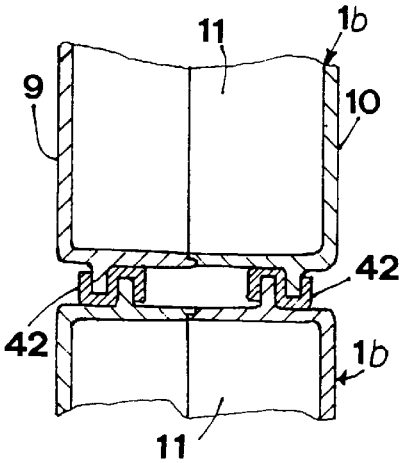
FIG. 24 is a sectional lateral elevational view of two superimposed modular components of FIGS. 18 to 22, held together by profiled elements according to FIG. 23.
Figure 25:
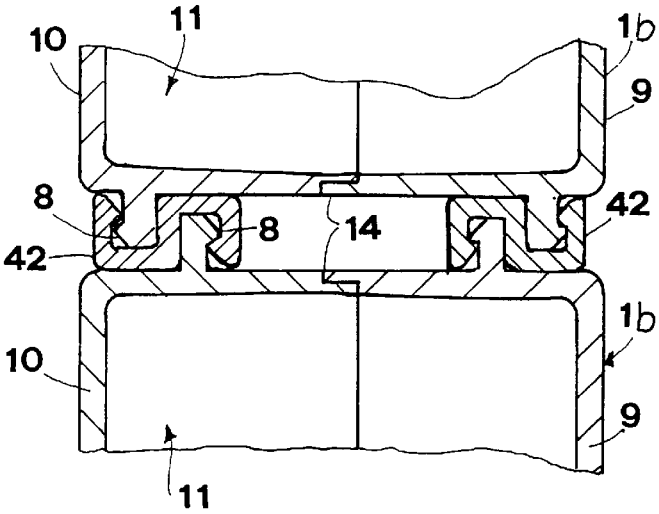
FIG. 25 is a view, similar to FIG. 24, also showing a different embodiment of the locking and trimming profiled element with snap-action locking.

In the embodiment of FIGS. 23 to 25, the modular components 1*b* have raised portions 7 and 8 or tabs 7*a* and 8*a* that are offset on adjacent sides 5 and 6; i.e., on one side the raised portions or tabs have a given spacing or mutual distance and a greater or smaller spacing on an adjacent side, whereas the locking and trimming profiled elements 42 are substantially S-shaped in cross-section, so as to form two mutually opposite seats 43 and 44 in order to engage, on one side, a side of a modular component 1 with tabs or raised portions that are spaced with a given spacing and, on the other side, a side of an adjacent modular component with tabs or raised portions having a different spacing.

In FIG. 25, the mutual engagement of raised portions 8 of two modular components 1*b* and profiled elements 42 occurs in a snap-together manner, by virtue of the undercut configuration of the seats 43 and 44 and of the raised portions or tabs 7 and 7*a,* 8 and 8*a*.

Figure 26:
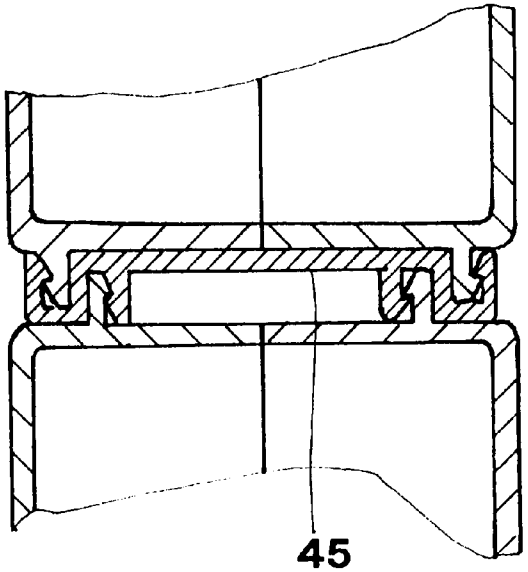
FIG. 26 is a sectional lateral elevation view showing another embodiment of the locking and trimming profiled element interconnecting two hollow modular components.

In the embodiment of FIG. 26, the locking and trimming profiled elements are shaped like those of FIGS. 24 and 25 but are coupled to each other by a transverse connecting portion 45.

Figure 27:
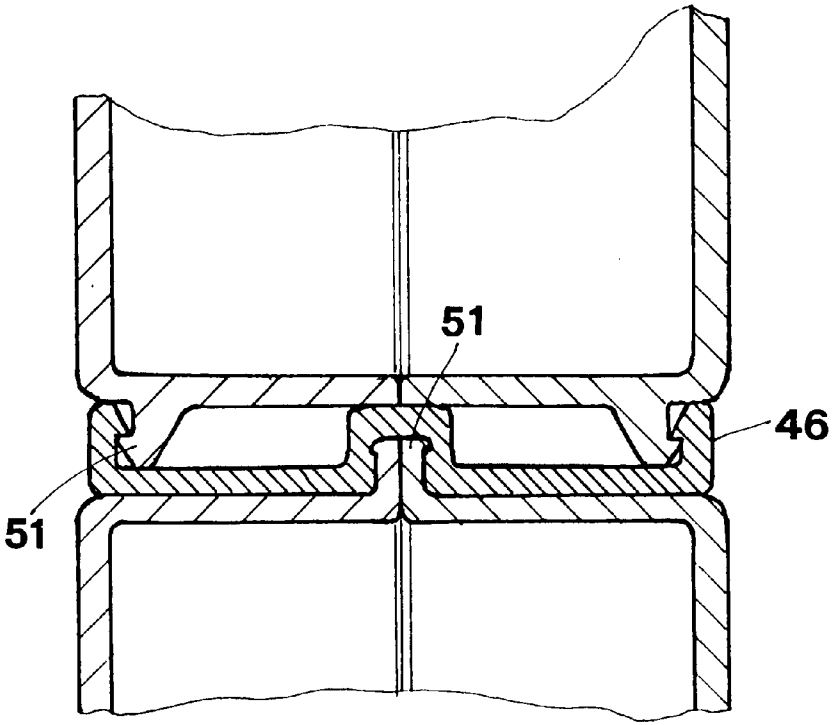
FIG. 27 is a sectional lateral elevation view similar to FIG. 26, showing a different embodiment of the locking and trimming profiled element interconnecting two hollow modular components.
Figure 28:
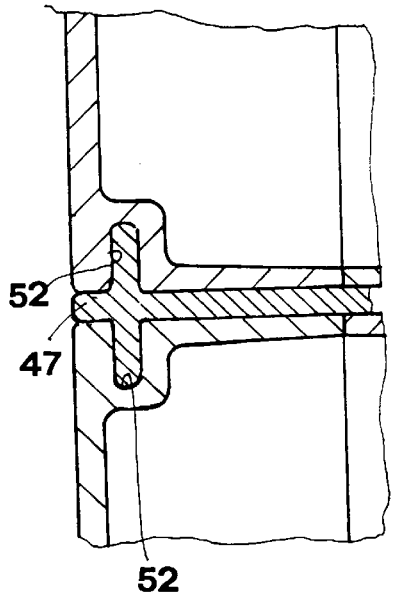
FIG. 28 is a sectional lateral elevation view similar to FIG. 26, showing a further embodiment of the locking and trimming profiled element interconnecting two hollow modular components of the system of structural elements according to the invention.
Figure 29:
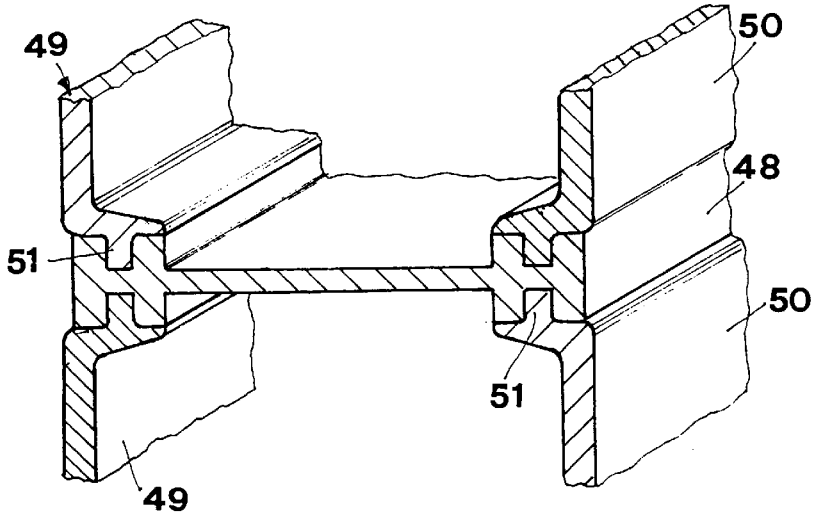
FIG. 29 is a perspective view, with parts shown in cross-section, of a further embodiment of the system with modular components, each component being formed by two panel-like elements with profiled ends that are kept together and spaced by adapted locking and trimming profiled elements.

FIGS. 27, 28, and 29 show a corresponding number of embodiments of monolithic locking and trimming profiled elements, respectively 46, 47, and 48, which are particularly adapted when, instead of each modular component 1, two panels 49 and 50 are used, said panels being provided with a raised peripheral contour edge 51 or with a peripheral groove 52 but not mutually rigidly coupled, being rather merely adjacent or free and mutually spaced (FIG. 29).

Figure 30:
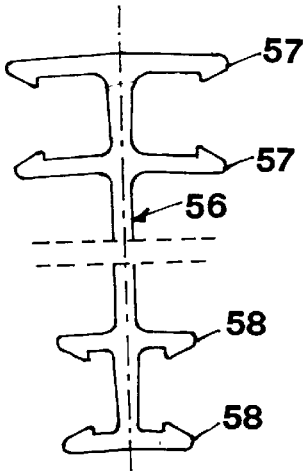
FIG. 30 is a side view of a locking profiled element for obtaining curved walls from modular components or from panels.

FIG. 30 is a view of a locking and trimming profiled element 56 that is similar to the profiled element 48 of FIG. 29, but is provided with ridges for engaging the edges 51 of the panels or the raised portions or tabs 7 and 8 that are arranged at an angle, in a symmetrical fashion, with respect to the median axis x—x of the profiled element. More particularly, the profiled element has two external ridges 57 that are higher than the two internal ridges 58 but have the same inclination (in the opposite direction) with respect to the axis x—x, for example 3–5 degrees.

The above described system of structural elements is susceptible to numerous modifications and variations within the protective scope defined by the content of the appended claims.

What is claimed is:

1. A system of structural elements for forming a wall, the system comprising:

a plurality of modular components each having sides with engagement means, so as to be laterally engageable when said modular components are connected together;

at least one covering profiled element adapted to be engaged with said modular components when said modular components are connected to form a wall, said profiled element supporting and engaging said modular components; and a plurality of locking profiled elements that can be accommodated between adjacent modular elements and connected to said modular components which are arranged so as to define rows of modular components;

each modular component being shaped like a parallelepiped with two larger faces having a square or rectangular contour and vertical and horizontal sides that are relatively narrow and presenting a plurality of raised portions protruding from the sides of each modular component shaped like a parallelepiped and aligned in pairs and spaced from one another;

each modular component comprises two half-shells, a male half-shell and a female half-shell, wherein the half-shells are adjacent to each other, are engaged with a male-female coupling, and form an internal space, each half-shell having sides;

each male half-shell is adapted to engage the female half-shell, the male half-shell having a pin or peg that protrudes in each corner and at least one straight raised portion along at least part of each one of said sides;

wherein each female half-shell has in each corner a seat for receiving one of said pins or pegs of the male half-shell, and at least one external straight recess arranged along at least part of said sides.

2. The system of structural elements according to claim 1, wherein each of said raised portions constitute an extension of an outer surface of the male half-shell.

3. The system of structural elements according to claim 1, wherein each male and female half-shell comprise at least one external raised portion on said sides for snap-together engagement with a top or bottom profile element and with at least one of said locking profiled elements.

4. The system of structural elements according to claim 3, wherein each external raised portion is configured with an undercut for snap-together engagement in a corresponding seat for accommodation in the top or profiled elements and in the locking profiled elements.

5. The system of structural elements according to claim 1, wherein each profiled element comprises an extruded element made of light allow or plastic that is mirror-symmetrical with respect to a median longitudinal sectional plane and is formed by a C-shaped inner core that delimits an internal interspace by a double set of lateral wings, which forms, on each side of the profiled element, an external trimming edge and two longitudinal grooves that are oriented in opposite directions.

6. The system of structural elements according to claim 5, wherein the opposite edges or lips of said grooves are provided with an inlet ridge that delimits an undercut for snap-together engagement with respective raised portions of the modular components.

7. The system of structural elements according to claim 6, wherein the grooves are adapted to engage free edges of a profiled or solid U-shaped element adapted to be fixed to a floor or to a ceiling of a room or to a vertical wall thereof.

8. The system of structural elements according to claim 1, comprising an L-shaped element having a pair of wings at one end thereof, an end profiled element to a fixed anchoring, which can be inserted and fixed, by means of one of said wings in an internal interspace of the end profiled element and can be fixed, at said other wing, to a lateral wall or to the ceiling or to the floor.

9. The system of structural elements according to claim 1, wherein each one of said locking profiled elements has a T-shaped ridge that protrudes from one side thereof, said profiled element delimiting, with a U-shaped portion, two opposite longitudinal seats for accommodating and retaining raised portions of the modular components.

10. The system of structural elements according to claim 9, wherein the T-shaped ridge has an outer face of a transverse wing that constitutes a trimming surface at a gap region between one modular component and the next.

11. The system of structural elements according to claim 10, wherein said locking profiled elements have a straight shape for building straight walls.

12. The system of structural elements according to claim 10, wherein said locking profiled elements have a curved shape for curved walls or wall portions.

13. The system of structural elements according to claim 10, wherein said locking profiled elements are used in pairs, one on one side of the modular components and one on the other side of said modular components.

14. The system of structural elements according to claim 11, wherein said locking profiled elements are substantially S-shaped in cross-section, so as to delimit two opposite seats in order to engage, on one side thereof, a side of one of said modular components with tabs or raised portions that are spaced by a given amount and, on the other side thereof, a side of an adjacent modular component with tabs or raised portions having a different spacing.

15. The system of structural elements according to claim 14, wherein said pairs of locking profiled elements are coupled to each other by a transverse connection portion.

16. The system of structural elements according to claim 15, wherein said modular components each comprise two facing panels that are kept in position by said pairs of locking profiled elements which are provided with a raised contour edge or with a peripheral engagement groove.

17. The system of structural elements according to claim 15, wherein said pairs of locking profiled elements have wings that are mirror-symmetrical and inclined with respect to said transverse connection portion to obtain curved walls.

18. The system of structural elements according to claim 11, wherein said modular components have machined or variously shaped internal surfaces so as to distort images without substantially reducing the passage of light.

* * * * *